US006854803B2

(12) United States Patent
Tomas et al.

(10) Patent No.: US 6,854,803 B2
(45) Date of Patent: Feb. 15, 2005

(54) CONVERTIBLE BATHROOM FURNITURE

(75) Inventors: Jorge Tomas, Wrentham, MA (US); Kurt Nygren, Harvard, MA (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 10/412,405

(22) Filed: Apr. 11, 2003

(65) Prior Publication Data

US 2004/0201260 A1 Oct. 14, 2004

(51) Int. Cl.[7] ..... A47C 16/00; A47C 25/00; A47C 13/00; A47C 7/62; A47C 3/024

(52) U.S. Cl. ..... 297/423.41; 297/461; 297/118; 297/130; 297/188.09; 4/571.1; 4/579; 4/580

(58) Field of Search ..... 297/423.41, 461, 297/118, 130, 108, 183.09, 151, 236, 237, 188.08; 4/571.1, 572.1, 586, 587, 579; 220/780, 212; 206/326, 216, 576, 372, 373; 312/235.1, 235.2, 235.5, 235.6

(56) References Cited

U.S. PATENT DOCUMENTS

| | | | | | |
|---|---|---|---|---|---|
| D35,304 | S | * | 11/1901 | Pendergrast | 178/98 |
| 866,745 | A | * | 9/1907 | Talge | 312/235.5 |
| 1,227,229 | A | * | 5/1917 | Abramson | 312/235.5 |
| 2,140,902 | A | | 12/1938 | Fischer | |
| 2,302,806 | A | | 11/1942 | Senter | |
| 2,327,288 | A | * | 8/1943 | Post | 297/188.08 |
| 2,625,204 | A | * | 1/1953 | Reichman | 297/105 |
| 2,765,025 | A | * | 10/1956 | Bakalic et al. | 297/188.08 |
| 2,804,122 | A | * | 8/1957 | Baum | 108/13 |
| 2,965,153 | A | * | 12/1960 | Purcell, Sr. | 248/240.1 |
| 4,047,259 | A | | 9/1977 | Lotis | |
| 4,356,575 | A | | 11/1982 | Terry | |
| 4,630,323 | A | | 12/1986 | Sage et al. | |
| 4,650,249 | A | * | 3/1987 | Serber | 297/313 |
| 4,836,368 | A | * | 6/1989 | Cotton | 206/205 |
| 4,937,897 | A | * | 7/1990 | Barnabie | 4/580 |
| 5,074,619 | A | * | 12/1991 | D'Orsi et al. | 297/236 |
| 5,134,974 | A | * | 8/1992 | Houser | 119/168 |
| 5,313,675 | A | * | 5/1994 | Tinen | 4/580 |
| 5,507,385 | A | * | 4/1996 | Koloski et al. | 206/372 |
| 5,551,101 | A | * | 9/1996 | Leach | 4/580 |
| 5,594,190 | A | * | 1/1997 | Malta | 84/453 |
| 5,597,199 | A | * | 1/1997 | Hoffman et al. | 297/144 |
| 5,642,535 | A | * | 7/1997 | Frawley et al. | 4/559 |
| 5,738,239 | A | * | 4/1998 | Triglia | 220/495.07 |
| 5,779,047 | A | * | 7/1998 | Darrah | 206/373 |
| 5,810,430 | A | * | 9/1998 | Bryjak et al. | 297/17 |
| 5,983,418 | A | * | 11/1999 | Goodman et al. | 4/571.1 |
| 6,174,026 | B1 | * | 1/2001 | Wise | 297/120 |

FOREIGN PATENT DOCUMENTS

| | | | | |
|---|---|---|---|---|
| GB | 2119241 | A | * 11/1983 | A47K/3/12 |

* cited by examiner

*Primary Examiner*—Peter M. Cuomo
*Assistant Examiner*—Sarah C. Burnham
(74) *Attorney, Agent, or Firm*—Barnes & Thornburg LLP

(57) ABSTRACT

Furniture capable of being assembled in one way to produce a step stool and in another way to produce a kneeler. The furniture includes a base unit and a lid releasably secured to the base unit to produce the step stool or to produce the kneeler. The furniture includes an armrest and a connecting member. The kneeler is configured for use alongside a bathtub.

31 Claims, 8 Drawing Sheets

CONVERTIBLE BATHROOM FURNITURE

BACKGROUND AND SUMMARY

This disclosure relates to convertible furniture, and particularly, to furniture that is convertible from one configuration to another configuration. More particularly, this disclosure relates to step stools and kneelers.

Caregivers are often called upon to kneel alongside a tub during bathroom time for a juvenile under their care. Maintaining such a posture can be uncomfortable. At the same time, juveniles oftentimes are unable to access a sink or countertop on a bathroom vanity. Caregivers and juveniles would welcome bathroom furniture configured to address the foregoing kneeling and access problems.

According to the present disclosure, a furniture unit includes several pieces which cooperate to provide a furniture kit. These pieces can be combined in the field in one way to produce a step stool and in another way to produce a tubside kneeler. The furniture unit includes a base unit formed to include a receptacle, a lid sized to fit into the receptacle, and a kneeler accessory sized to be stored in the receptacle in a space between the base unit and the lid.

In one step stool configuration, the lid is mounted on the base unit to provide an elevated step and to provide a storage space in the receptacle under the lid. The kneeler accessory is sized to be stored under the lid in the storage space when the pieces in the furniture unit are assembled to produce a step stool.

In an illustrative embodiment, the kneeler accessory comprises a foldable armrest that can be unfolded to mount on a rim or ledge of a bathtub and folded to fit into the storage space between the base unit and the lid. The kneeler accessory further comprises a pliable web coupled at one end to the armrest and configured at the other end to be coupled to the base unit to link the base unit to the armrest when the furniture unit pieces are assembled to produce a tubside kneeler.

In one tubside kneeler configuration, the lid is inverted and nested in the receptacle formed in the base unit (after the kneeler accessory has been removed from the storage space) to provide a kneeler that can be placed on the floor alongside a bathtub. The armrest is then unfolded and mounted on the rim of the bathtub and the pliable web is allowed to drape along the outer wall of the tub. A lower end of the pliable web is coupled to the base unit to link the armrest to the base unit. Bath accessories can be stored in pockets provided on an exposed surface of the draped pliable web.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying Figures in which.

DETAILED DESCRIPTION

Figure 1:
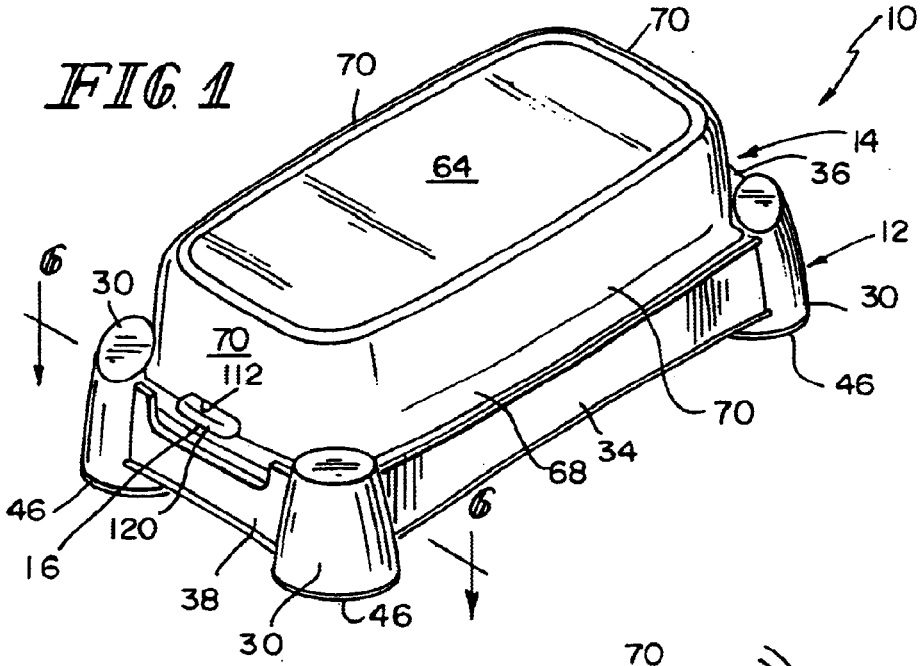
FIG. 1 is a perspective view of an embodiment of the present disclosure in the form of bathroom furniture in a "step stool" mode wherein the lid is mounted on the underlying base unit to cause an elevated step included in the lid to extend upwardly from the base unit to form a one-step step stool.

The present disclosure is directed to furniture which, in the embodiment illustrated in FIGS. 1–17, for example, is in the form of bathroom furniture 10 comprising a base unit 12, a lid 14, a pair of releasable latch mechanisms 16 associated with lid 14, and a kneeler accessory 17 configured to be stored in base unit 12 when not in use. Kneeler accessory 17 comprises an armrest 18, a pliable web or connecting member 20 and a pair of suction members 22 associated with armrest 18. The bathroom furniture 10 can be converted from a step stool (see, e.g., FIG. 1) to a kneeler (see, e.g., FIG. 4) and vice versa.

Figure 2:
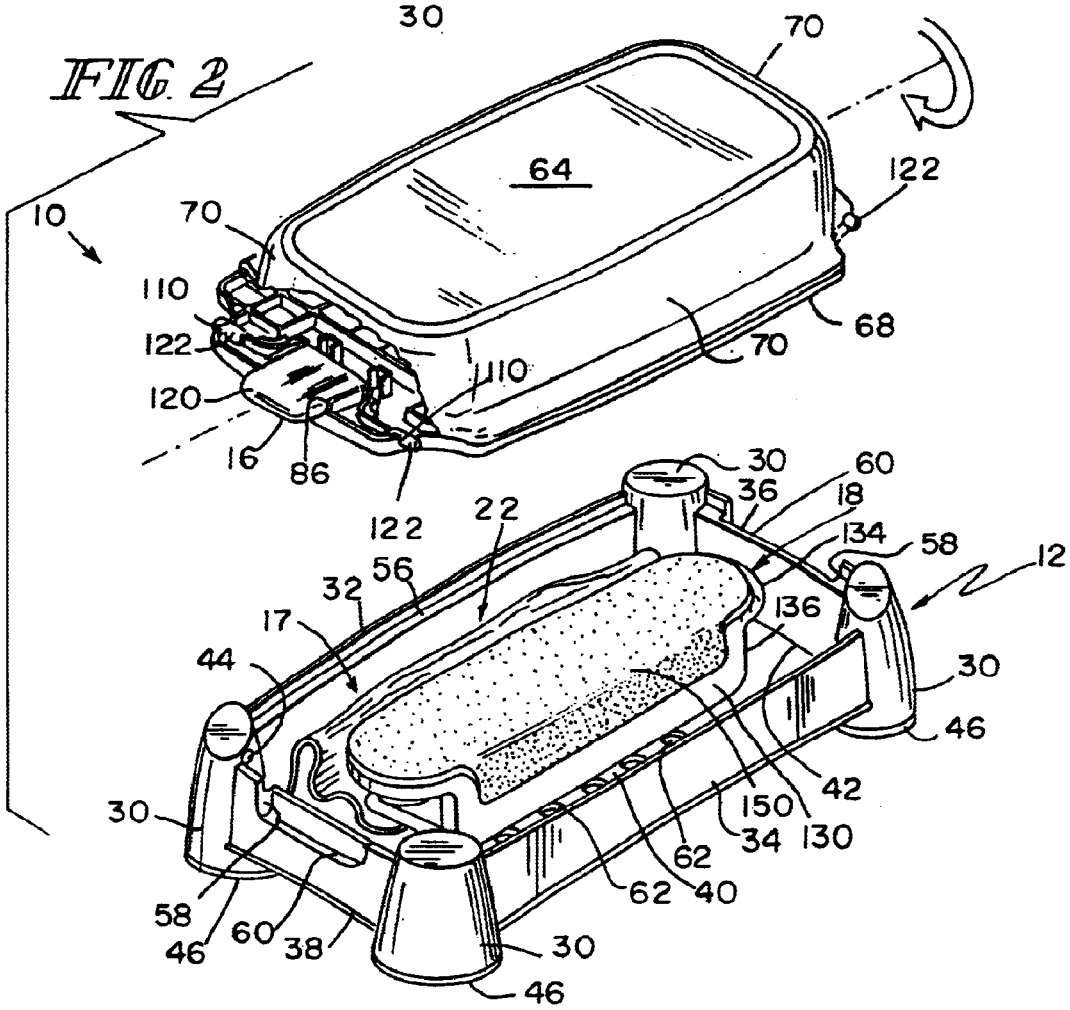
FIG. 2 is a perspective view similar to FIG. 1 showing the lid, with portions broken away, to reveal one of two releasable latch mechanisms housed in the lid and used to anchor the lid to the base unit in either the step stool mode shown in FIG. 1 or a "tubside keneeler" mode shown in FIG. 4 and showing removal of the lid from the base unit to expose a kneeler accessory stored in the receptacle formed in the base unit.
Figure 3:
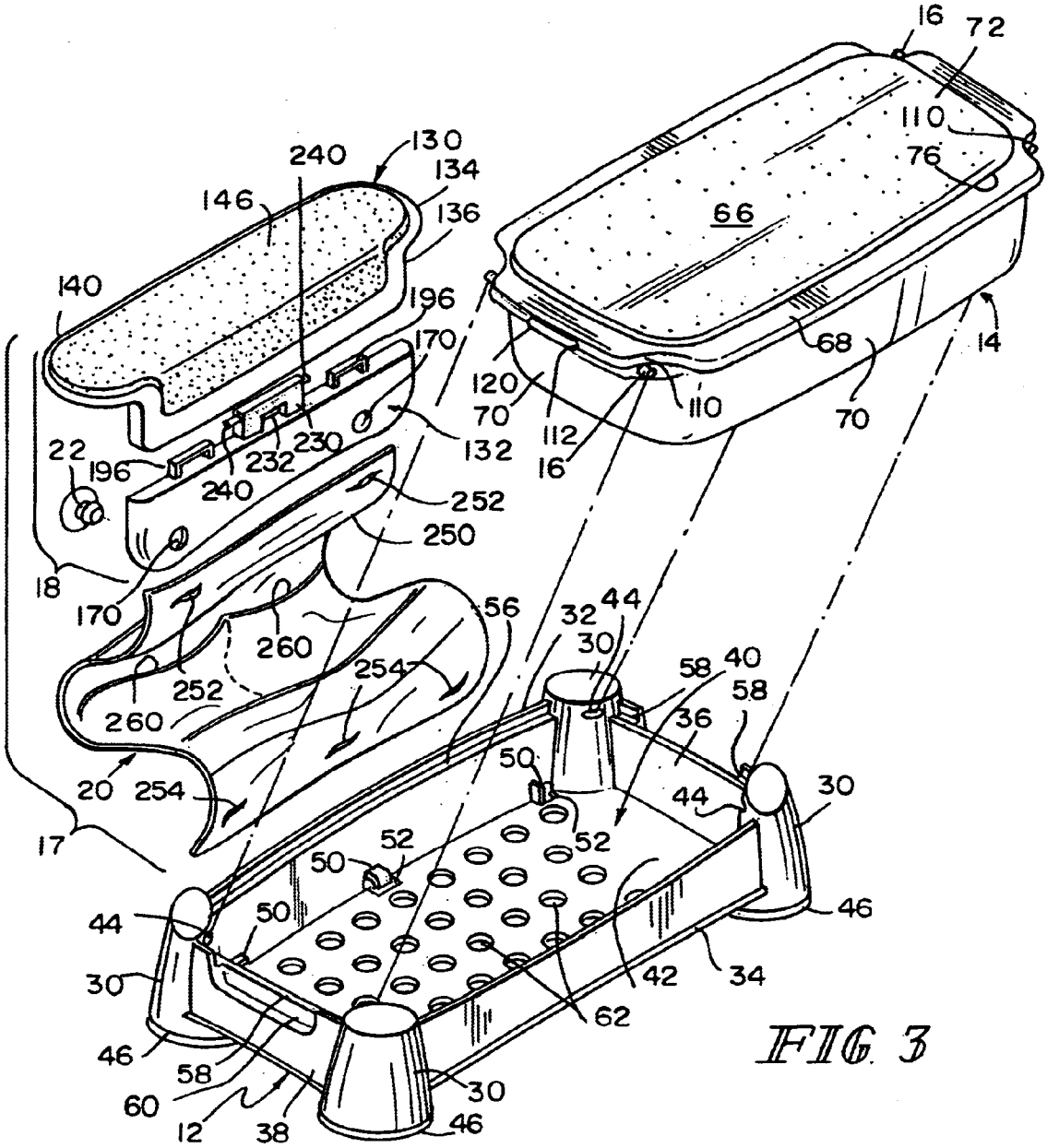
FIG. 3 is a perspective view similar to FIGS. 1 and 2 showing removal of the kneeler accessory (e.g. an armrest and a pliable web) from a receptacle formed in the base unit and showing reversal of the lid to cause a knee pad included in the lid to face upwardly and the elevated step included in the lid to face downwardly so that the lid is oriented to be mounted to the base unit in the tubside kneeler mode shown in FIG. 4.
Figure 4:
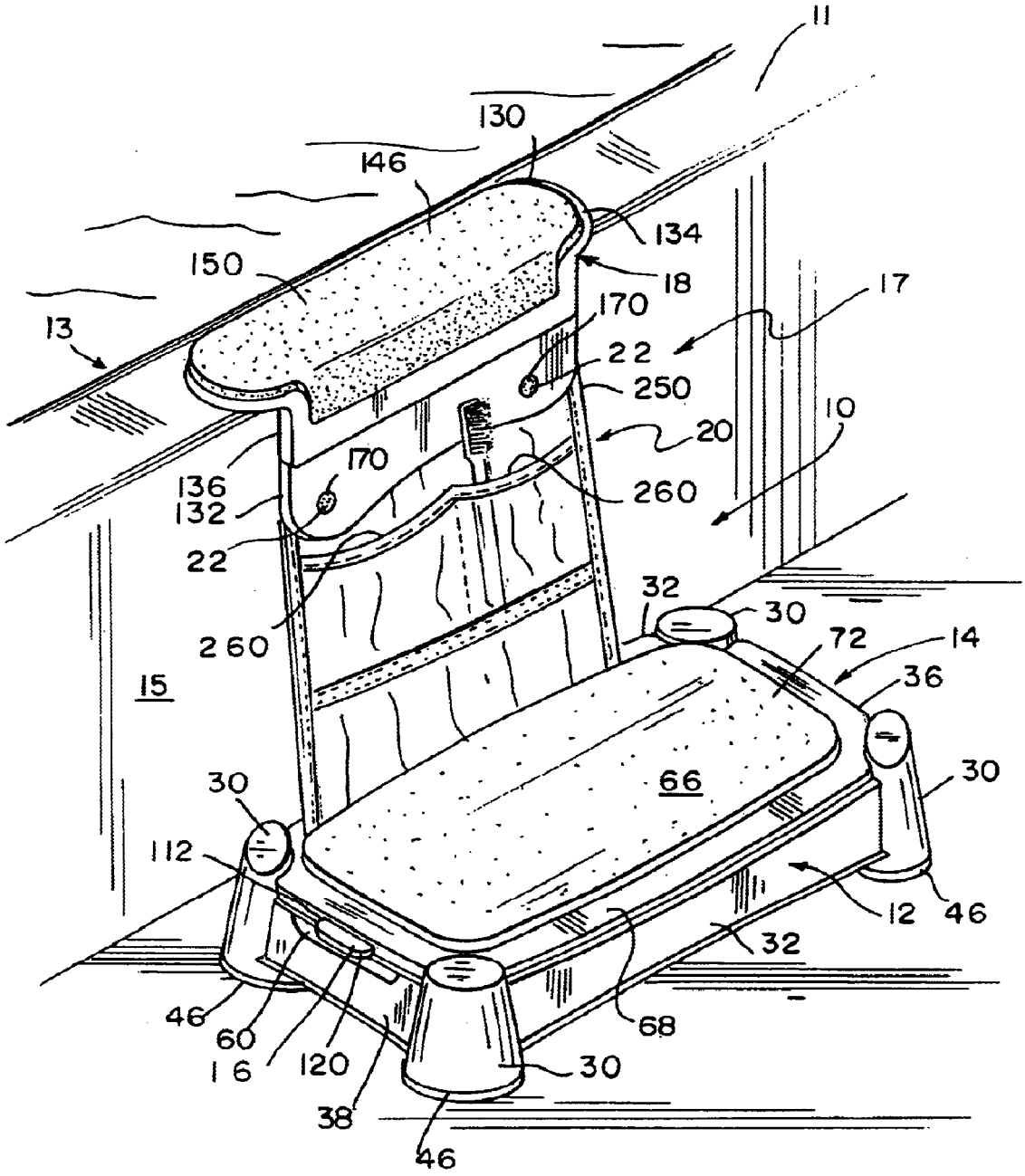
FIG. 4 is a perspective view similar to FIGS. 1–3 showing the bathroom furniture in the tubside kneeler mode wherein the elevated step included in the lid is placed in the receptacle formed in the base unit to expose the knee pad on the lid so that the base unit and the lid cooperate to form a kneeler located adjacent to a bathtub, the armrest is assembled and mounted on the ledge of the bathtub to allow a person using the kneeler to rest their arms comfortably on the armrest, and the pliable web is arranged to extend downwardly from the armrest to the base unit to connect the armrest to the kneeler and to provide pockets for storing bathroom accessories.
Figure 5:
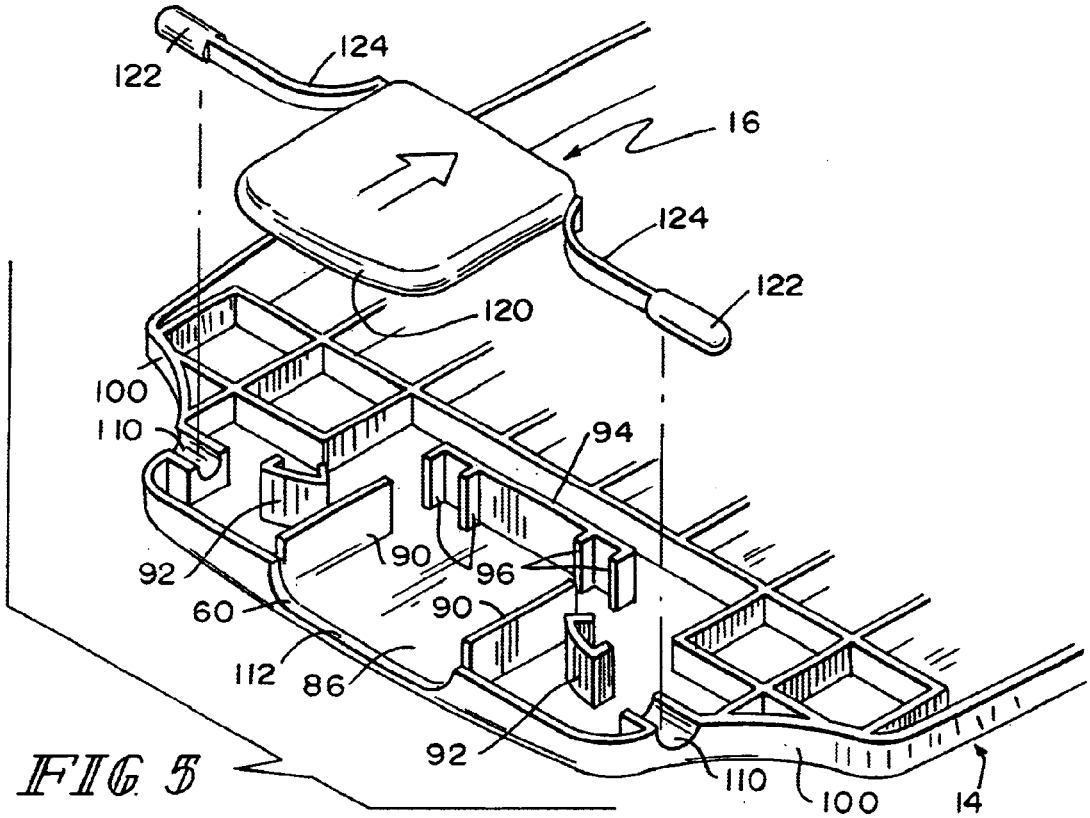
FIG. 5 is an enlarged, exploded, perspective broken view of a portion of the lid showing one of the releasable latch mechanisms and the latch-receiver pocket defined by the lid.
Figure 6:
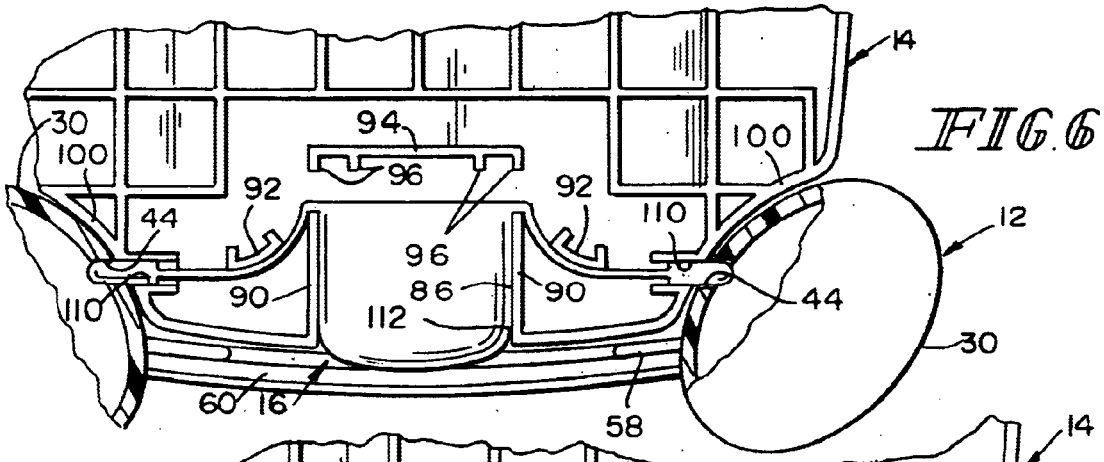
FIG. 6 is a broken sectional view taken along line 6—6 of FIG. 1 showing the releasable latch mechanism in a secured or locked position to anchor the lid to the base unit.
Figure 7:
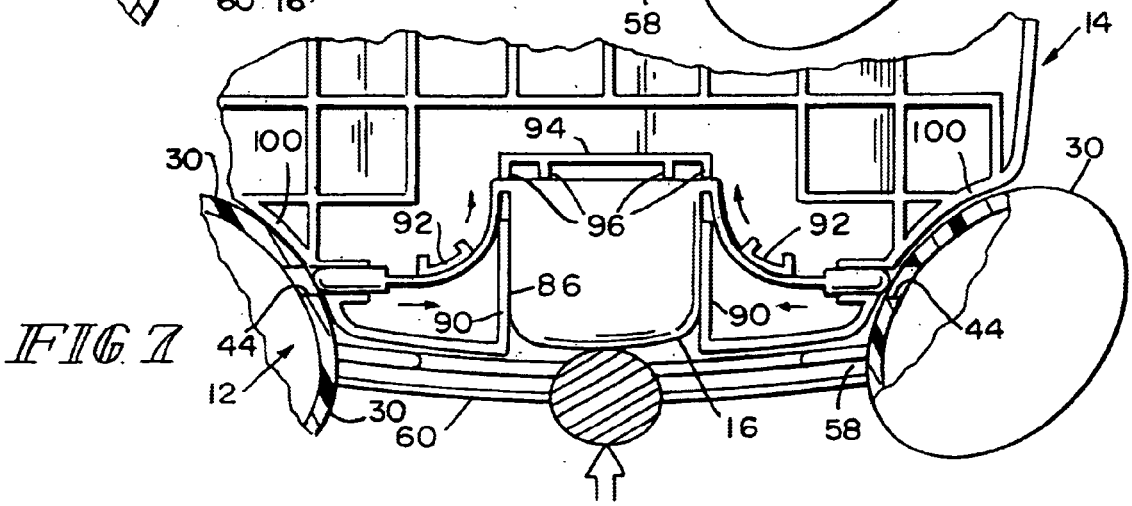
FIG. 7 is a broken sectional view similar to FIG. 6 showing movement of the latch mechanism to a released position to allow a user to remove the lid from the base unit.

Base unit 12 in the illustrative embodiment comprises four hollow leg members 30, a pair of opposed first rails 32, 34, a pair of opposed second rails 36, 38, and a bottom 40 which defines a receptacle 42 as shown, for example, in FIGS. 1 and 2. Each of the four leg members 30 defines a slot 44 for engaging one of the releasable latch mechanisms 16 to retain lid 14 in a step stool position as shown in FIG. 1 or a kneeler position as shown in FIG. 4 as described hereinafter.

Base unit 12 also includes four rubber footings 46 removably engaged with leg members 30 to reduce slippage of bathroom furniture 10 on a bathroom floor (not shown). First rail 32 includes three downwardly-extending hooks 50 for engaging slits 254 formed in connecting member 20 and lying adjacent openings 52 as suggested in FIG. 3. Each of first rails 32, 34 includes a ledge 56 for engaging lid 14. Each of second rails 36, 38 also includes a ledge 58 for engaging lid 14, but also defines an external longitudinally extending recess 60 for receiving fingers to facilitate ready manual disengagement of lid 14 from base unit 12. Bottom 40 defines a plurality of holes 62 for drainage and ventilation purposes. Base unit 12 is constructed of any suitable material such as, for example, any suitable polyethylene.

Lid 14 in the illustrated embodiment includes a step side 64, a kneel side 66, a peripheral lip 68, a plurality of walls 70, and a knee pad 72 in the form of foam or rubber padding overmolded or otherwise retained on kneel side 66. Kneel side 66 includes a ridge 76 surrounding knee pad 72 and defining a cavity (not shown) that receives knee pad 72. Lid 14 defines a pair of latch-receiver pockets 86 adjacent its opposed ends. Each latch-receiver pocket 86 is defined by a pair of walls 90, a pair of curved biasing surfaces 92, and a rear wall 94 including a plurality of stops 96. Lid 14 also includes inwardly curved surfaces 100 to define indentations to receive leg members 30. Lid 14 defines a pair of holes 110 and a slot 112 adjacent each of its ends to receive each of releasable latch mechanisms 16. Latch-receiver pockets 86, curved surfaces 100, holes 110, and slots 112 are substantially closer to kneel side 66 than step side 64. Lid 14 is constructed of any suitable material such as, for example, any suitable polyethylene.

Each of releasable latch mechanisms 16 in the illustrated embodiment comprises a button 120, a pair of lateral latches 122, and a pair of flexible arms 124 connecting button 120 with latches 122. Each of releasable latch mechanisms 16 is received by one of latch-receiver pockets 86 such that a lead portion of the button 120 extends through a respective slot 112, and latches 122 extend through a respective pair of holes 110 for releasable securement to base unit 12. The curved biasing surfaces 92 engage flexible arms 124 and bias releasable latch mechanism 16 toward the latching or securing position. When releasable latch mechanism 16 is moved from the secured position to the unlatched or unsecured position, stops 96 limit the movement of button 120. Button 120, lateral latches 122, and flexible arms 124 may be constructed of any suitable material, such as, for example, any suitable polyethylene.

Releasable latch mechanisms 16 are releasably securable to base unit 12 in two alternative positions of lid 14, namely, a step position in which step side 64 faces up (see, e.g., FIG. 1) and a kneeler position in which kneel side 66 faces up (see, e.g., FIG. 4). Because releasable latch mechanisms 16 are located closer to kneel side 66 than step side 64, the combined height of base unit 12 and lid 14 is greater when lid 14 is in the step stool position than when lid 14 is in the kneeler position. Accordingly, such construction enables the step stool to have an increased elevation.

Armrest 18 in the illustrated embodiment has a two-part construction and comprises an upper portion 130 adapted to set on or otherwise engage a top ledge 11 of a bathtub 13 (see FIG. 4) and a lower portion 132 coupled to pliable web or connecting member 20. Armrest 18 is foldable between a compact or folded position and an L-shaped unfolded configuration (see, e.g., compare FIG. 2 with FIG. 4).

Figure 8:
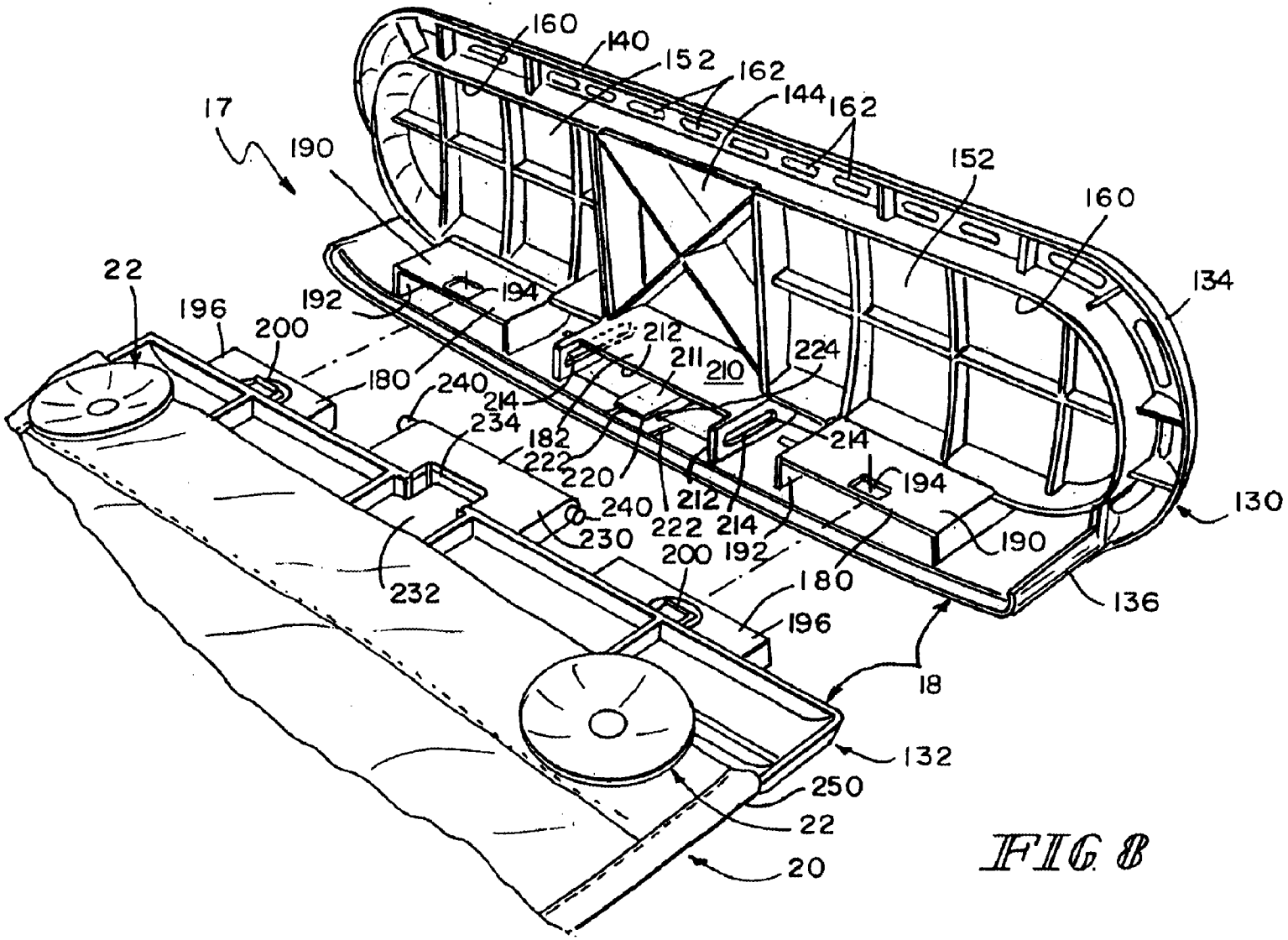
FIG. 8 is a broken perspective assembly view showing the two-part armrest of FIGS. 1–4 including the lower portion coupled to the upper end of the pliable web and the upper portion adapted to set on the ledge of the bathtubside wall before the lower and upper portions are mated to convert the armrest to the unfolded L-shaped configuration.
Figure 9:
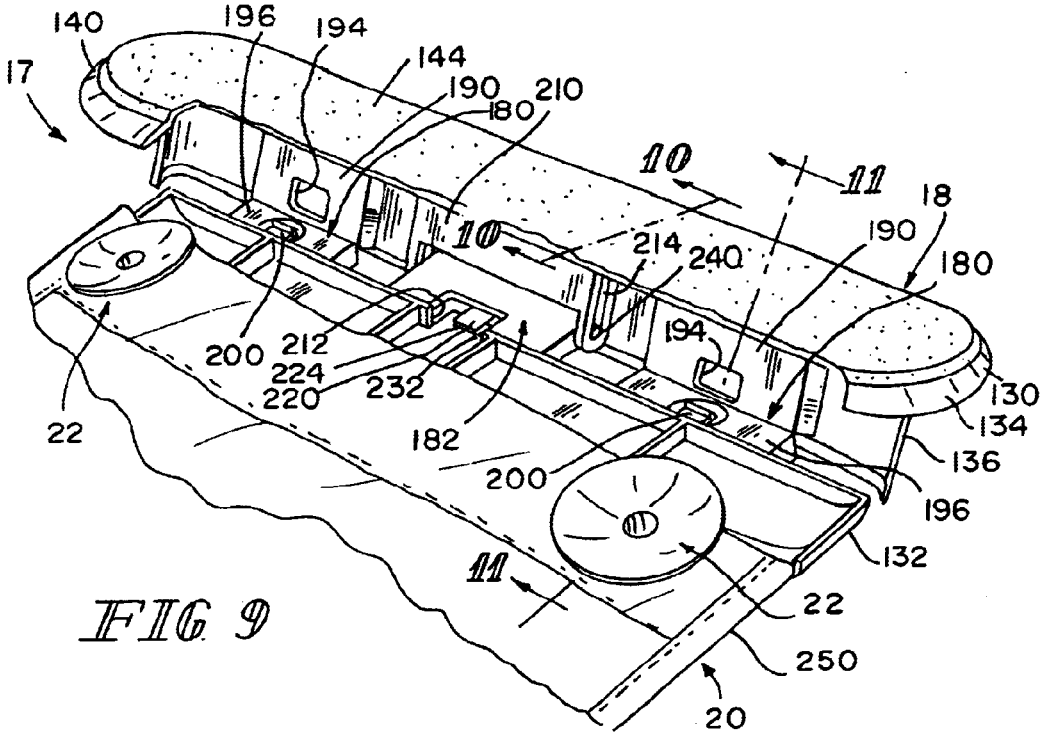
FIG. 9 is a broken perspective view of the armrest and the portion of the pliable web coupled to the armrest showing pivoting movement of the upper portion of the armrest relative to the lower portion of the armrest during a first stage of converting of the armrest to the unfolded, L-shaped configuration following removal of the armrest and pliable web from the receptacle formed in the base unit.
Figure 10:
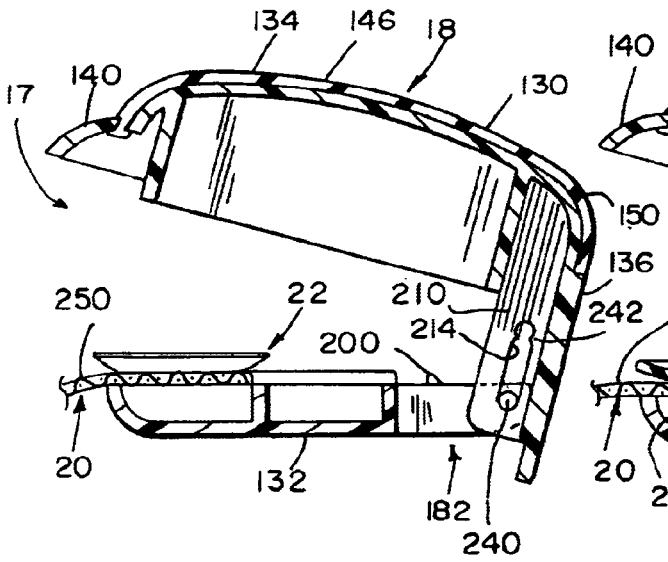
FIG. 10 is a sectional view taken along line 10—10 of FIG. 9.
Figure 11:
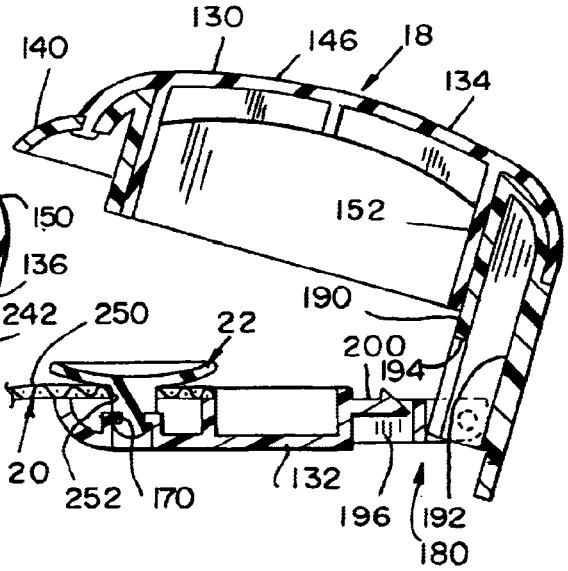
FIG. 11 is a sectional view taken along line 11—11 of FIG. 9.
Figure 12:
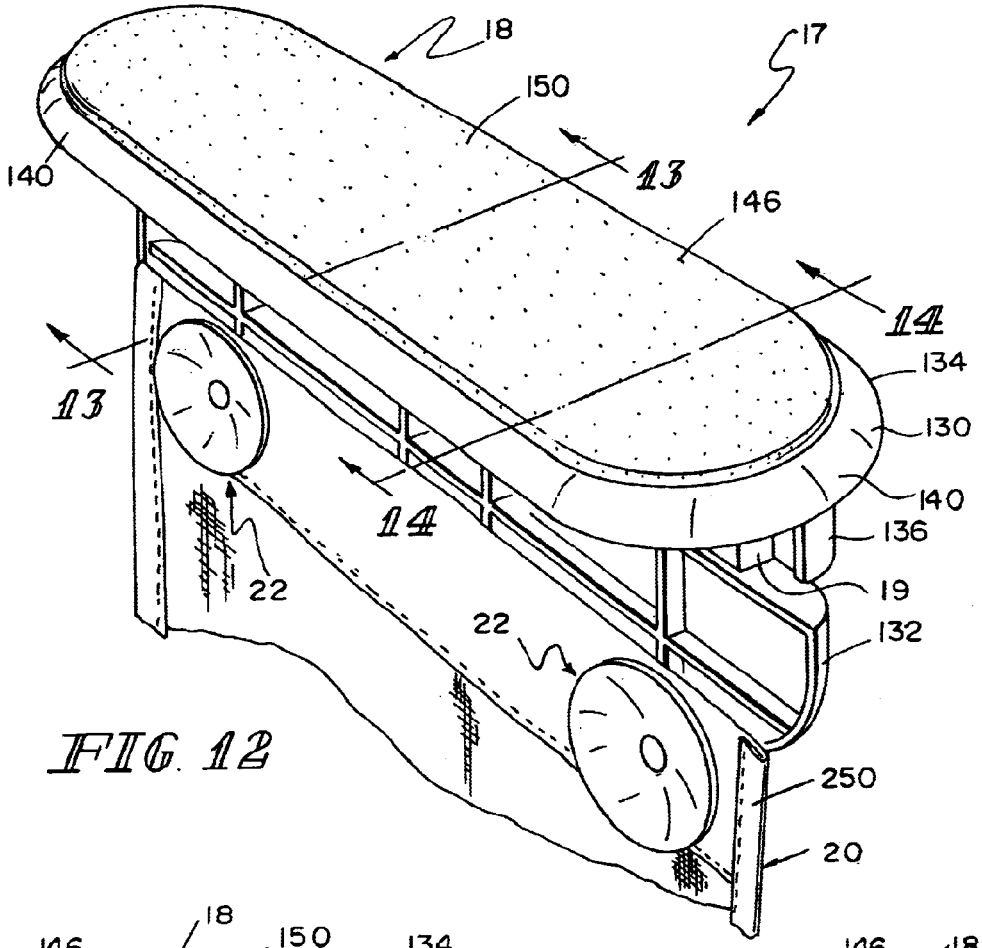
FIG. 12 is a perspective view similar to FIG. 9 showing the second stage of converting the armrest.
Figure 13:
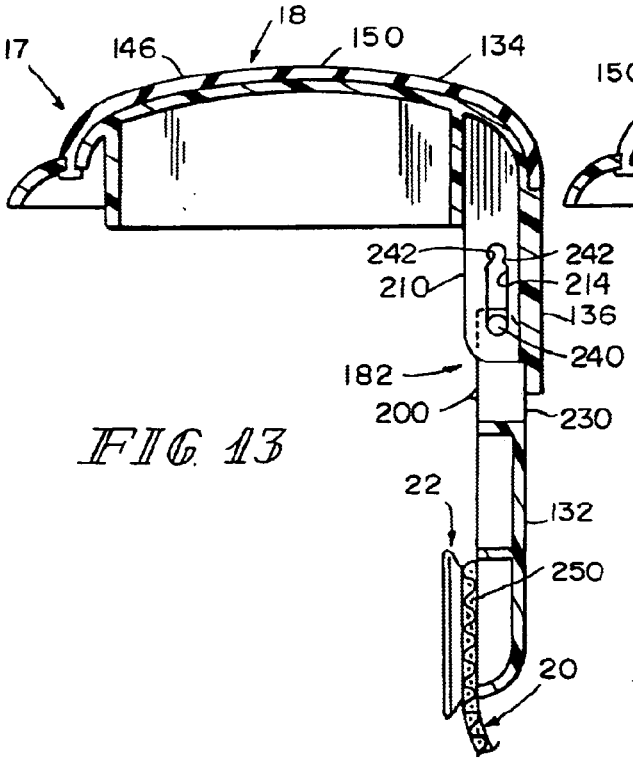
FIG. 13 is a sectional view taken along line 13—13 of FIG. 12.
Figure 14:
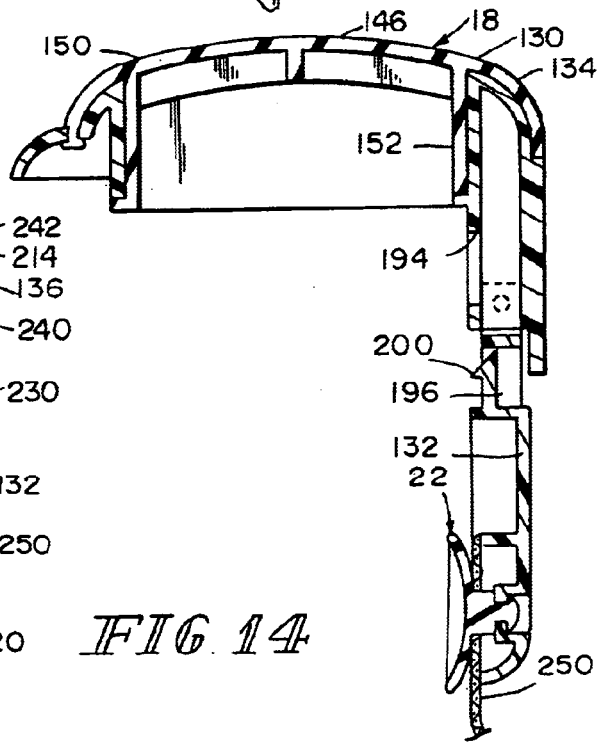
FIG. 14 is a sectional view taken along line 14—14 of FIG. 12.
Figure 15:
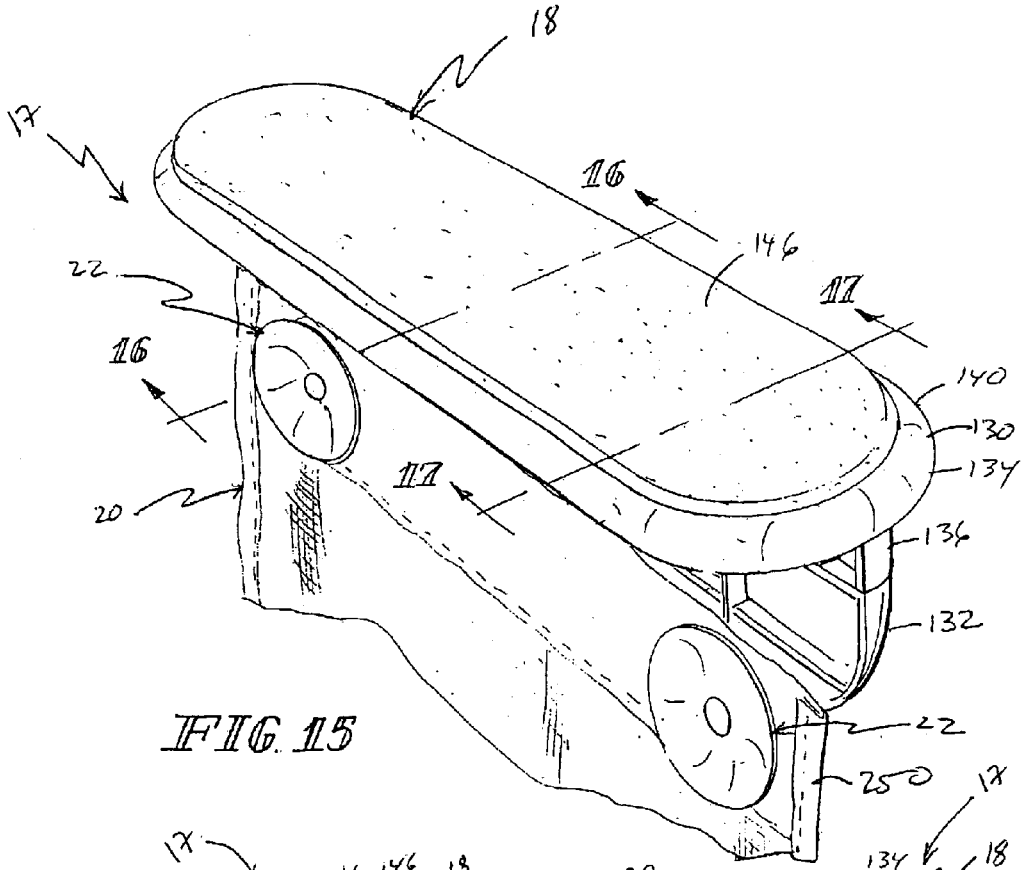
FIG. 15 is a perspective view similar to FIGS. 9 and 12 showing a final third stage of converting the armrest.
Figure 16:
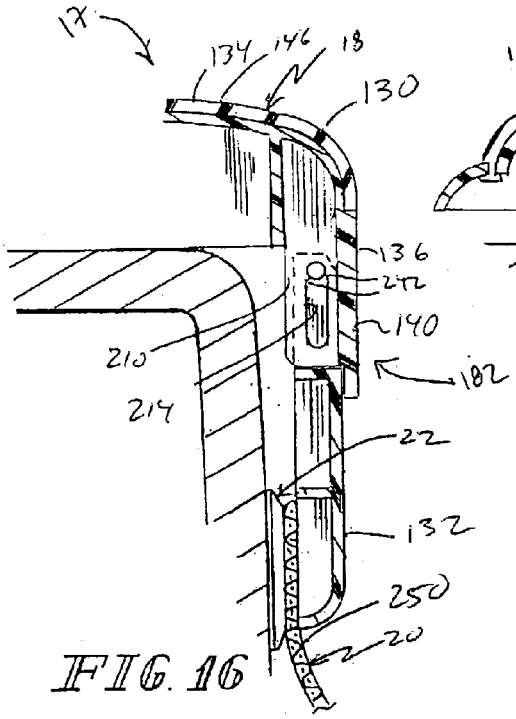
FIG. 16 is a sectional view taken along line 16—16 of FIG. 15.
Figure 17:
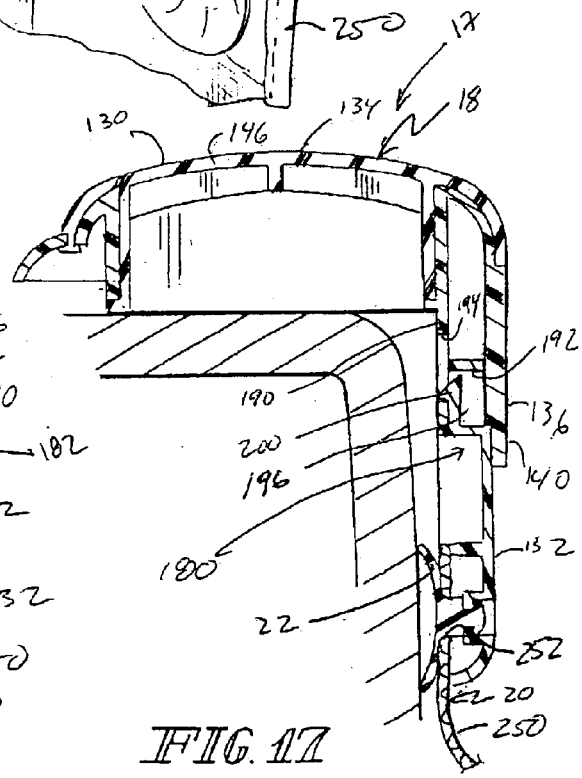
FIG. 17 is a sectional view taken along line 17—17 of FIG. 15.

Upper portion 130 of armrest 18 includes a support portion 134 and a lip portion 136 as shown, for example, in FIG. 8. Support portion 134 includes a rim 140 and a central support 144 integral with rim 14. Rim 140 and central support 144 may be constructed of any suitable material such as, for example, any suitable polyethylene. Upper portion 130 also includes a rubber overmold 146 engaged with rim 140 and central support 144 to provide support and comfort to the caregiver. Rubber overmold 146 includes an elongated top portion 150 and a pair of mating portions 152 received by a pair of openings 160 defined by rim 140 and central support 144. Rubber overmold 146 is molded onto rim 140 and central support 144 in any suitable manner. Rubber overmold 146 includes staking portions 162 that extend through the holes (not shown) of rim 140 and are molded onto rim 140 during the overmold process. Lower portion 132 also includes a pair of holes 170 for receiving and engaging suction members 22.

Upper and lower portions 130 and 132 include a pair of releasable latch assemblies 180 and a releasable latch-and-hinge assembly 182 disposed between releasable latch assemblies 180 to facilitate the ready conversion of armrest 18 between the compact and unfolded positions. Releasable assemblies 180 and 182 releasably secure armrest 18 in the L-shaped configuration and enable the ready release of releasable assemblies 180, 182 and pivoting of lower portion 132 relative to upper portion 130 so that armrest 18 can be readily folded to the compact position. Releasable assemblies 180 and 182 maintain releasable engagement between upper and lower portions 130 and 132 and also permit unlatching of the lower portion and rotation thereof to the folded position.

Each of releasable latch assemblies 180 includes a wall 190 extending from lip portion 136 defining a rectangular receptacle 192 and an aperture 194, and a tongue 196 of lower portion 132 received by the rectangular receptacles. Each tongue 196 includes a flexible latch 200 adapted to be received by aperture 194 and engage wall 190 adjacent the aperture. Releasable latch assemblies 180 can be readily disengaged by pressing latches 200 and pulling lower portion 132.

Releasable latch-and-hinge assembly 182 includes a first wall 210 extending from lip portion 136 that defines a receptacle 212 and a pair of opposed slots 214, a second wall 216 within the receptacle 212 that includes a tab 220, and a pair of camming surfaces 222 that define a pocket 224.

Releasable latch-and-hinge assembly 182 also includes a first tongue 230 extending from lower portion 132 for extending into receptacle 212 and a second tongue 232 adapted to extend into pocket 224 and releasably engage tab 220. First tongue 230 includes a pair of pins 240 received within slots 214 of the wall 210 to facilitate sliding and rotation of first tongue 230 relative to lip portion 136. First wall 210 includes necking portions 242 defining slots 214 to releasably lock pins 240 in place when armrest 18 is in the L-shaped configuration. Lip portion 136 prevents lower portion 132 from rotating more than 90° away from lip portion 136 when armrest 18 is converted to the L-shaped configuration. First tongue 239 also defines a cut-out 234 above second tongue 232. When armrest 18 is engaged in the L-shaped configuration (see, e.g., FIGS. 9–11), tongues 196 and 230 are received by receptacles 192 and 212, respectively; latches 200 are engaged with walls 190; tongue 232 is received by pocket 224; and pins 240 are engaged with neck portions 242.

Conversion of armrest 18 from the L-shaped configuration to the folded position may occur in stages. First, lower portion 132 is releasably disengaged from lid portion 136 of upper portion 130, by manually pulling lower portion 132 relative to lip portion 136, which causes latches 200 to disengage from apertures 194 and pins 240 to disengage from neck portions 242 and the lower portion to slide relative to the lip portion 136 (see, e.g., FIGS. 12–14). As this occurs, tongues 196 and 230 slide relative to walls 190, respectively; tongue 230 maintains contact with wall 210; and pins 240 slide within slots 214. Next, lower portion 132 is rotated relative to lip portion 136. As this occurs, pins 240 permit rotation of lower portion 132 while also maintaining engagement between lower and upper portions 130 and 132 (see, e.g., FIGS. 15–17).

Connecting member 20 in the illustrative embodiment is a pliable web and is configured to connect base unit 12 with armrest 18. Connecting member 20 includes an upper portion 250 that defines a pair of holes 252 for receiving suction members 22 and defines three slits 254 for engaging hooks 50 of base unit 12. Connecting member 20 may be constructed of any suitable material, such as, for example, a pliable mesh material. Connecting member 20 defines pockets 260 for receiving bathing accessories, such as, for example, a brush, shampoo, soap, etc. . . . .

Each suction member 22 in the illustrative embodiment includes an engaging stem 272 and a suction cup 274. The stems 272 extend through holes 252 of connecting member 20 and holes 170 of armrest 18 to engage armrest 18. Each suction member 22 also includes a cap 276 for maintaining suction member 22 in engagement with armrest 18. Suction cups 274 are configured to engage side walls 15 of bathtub 13.

Bathroom furniture 10 in the illustrated embodiment is convertible between a step stool position and a kneeler position. In the step stool position, armrest 18 and connecting member 20 are received by receptacle 42 of base unit 12, with armrest 18 in its folded position and connecting member 20 rolled around it. Lid 14 is releasably secured to base unit 12 such that step side 64 faces up and lid 14 encloses receptacle 42. The step stool may be used for any suitable bathroom or other purpose, such as for example, enabling a child to use a bathroom sink or toilet.

Bathroom furniture 10 maybe converted to the kneeler position in any suitable manner. For example, lid 14 may be disengaged from base unit 12 by depressing buttons 120, grasping lid 14 on both ends, and lifting lid 14 upward. Recesses 60 facilitate grasping of lid 14. Connecting member 20 is unrolled and armrest 18 is converted to the unfolded position. The one end of connecting member 20 is secured to base unit 12 by hooks 50. Armrest 18 is then engaged with ledge 11 of bathtub 13, and suction members 22 of connecting member 20 may be engaged with side 15 of the bathtub 13. Lid 14 is "flipped" over and releasably secured to base unit 12, such that kneel side 66 faces upward. Bathroom furniture 10 can be used to bathe a child in bathtub 13 by kneeling on kneel side 66 and using armrest 18. Because of the location of releasable latch mechanisms 16, the height of the combination lid 14 and unit 12 is less than the height of the combination when it is in the step stool position. Pockets 60 of connecting member 20 may be used to hold bathing accessories as suggested in FIG. 4.

Bathroom furniture 10 may be converted back to the step stool position in any suitable manner. For example, lid 14 may be disengaged from base unit 12, and armrest 18 disengaged from ledge 11 of bathtub 13. Armrest 18 is folded to a compact position by pulling lower portion 132 to release releasable assemblies 180 and 182, and thereafter rotating lower portion 132 (see above). Connecting member 20 may then be rolled around armrest 18. Connecting member 20 may be maintained in engagement with base unit 12 by hooks 50, or may be disengaged. Armrest 18 and connecting member 20 may then be placed into the storage space provided in receptacle 42 of base unit 12. Lid 14 is flipped over and re-engaged with base unit 12 such that step side 64 faces up and lid 14 covers the stored armrest 18 and connecting member 20. Armrest 18 also can be used just with a kneeler that is not convertible to a step stool or in applications other than bathroom furniture 10 described herein.

What is claimed is:

1. A bathroom furniture kit including components capable of being assembled in one way to produce a step stool and in another way to produce a kneeler, the kit comprising a base unit defining a receptacle, a lid releasably securable to the base unit and having a first padded side adapted for kneeling and a second side with an unpadded surface adapted for standing, wherein a peripheral lip of the first side abuts the base unit in a kneeling configuration and a peripheral lip of the second side abuts the base unit in a standing configuration, and an armrest, wherein the armrest is shaped to be received by the receptacle and the lid is releasably secured to the base unit and shaped to produce the step stool in one configuration, and wherein the armrest is shaped for mounting on a bathtub and the lid is releasably secured to the base unit to produce the kneeler in a second configuration.

2. The kit of claim 1, wherein a periphery includes substantially the entire outermost boundary.

3. The kit of claim 2, wherein the lid step side faces upward when the lid is releasably secured to the base unit in the standing configuration to produce the step stool, and the kneel side faces upward when the lid is releasably secured to the base unit in the kneeling configuration to produce the kneeler.

4. The kit of claim 3, wherein the step side and kneel side are opposite sides of the lid.

5. The kit of claim 1, further comprising a pliable connecting member releasably connecting the armrest to the base unit to produce the kneeler.

6. The kit of claim 5, wherein the connecting member is received by the receptacle when the lid is releasably secured to the base unit to produce the step stool.

7. The kit of claim 5, wherein the connecting member includes at least one pocket for receiving bathing accessories.

8. The kit of claim 5, further comprising at least one suction cup secured to the connecting member for connecting the connecting member to a wall of the bathtub when the lid is releasably secured to the base unit to produce the kneeler.

9. The kit of claim 1, further comprising at least one releasable latch mechanism releasably securing the lid to the base unit to produce a step stool and to produce a kneeler.

10. The kit of claim 9, wherein the releasable latch mechanism releasably secures the lid to the base unit when the lid is in a first position to produce the step stool and releasably secures the lid to the base unit when the lid is in a second position to produce the kneeler.

11. The kit of claim 10, wherein the lid includes a step side and a kneel side, the step side facing faces upward when the lid is releasably secured to the base unit in the first position to produce the step stool, and the kneel side facing faces upward when the lid is releasably secured to the base unit in a second position to produce the kneeler.

12. The kit of claim 11, wherein the releasable latch mechanism is secured to the lid and is positioned closer to the kneel side than the step side so that the combined height of the base unit and the lid is greater when the step stool is produced than when the kneeler is produced.

13. A bathroom furniture kit including components capable of being assembled in one way to produce a step stool and in another way to produce a kneeler, the kit comprising a base unit defining a receptacle, a lid releasably securable to the base unit, and an armrest, at least one releasable latch mechanism releasably securing the lid to the base unit to produce the step stool and to produce the kneeler, wherein the armrest is received by the receptacle and the lid is releasably secured to the base unit to produce the step stool, wherein the armrest is removed from the receptacle and engageable with a bathtub and the lid is releasably secured to the base unit to produce the kneeler, and wherein the lid defines a pocket and a pair of holes and the releasable latch mechanism includes a pair of latches, the releasable latch mechanism received by the pocket such that engaging members protrude through the holes, and the base unit defining a pair of apertures for receiving the latches to releasably secure the lid to the base unit to produce the step stool and to produce the kneeler.

14. The kit of claim 9, wherein the releasable latch mechanism includes a button for releasably unsecuring the lid from the base unit to convert the unit from one of a step or kneeler to the other of a step or kneeler.

15. The kit of claim 9, wherein the lid includes two ends and there are two releasable latch mechanisms, and each releasable latch mechanism is associated with a respective end.

16. The kit of claim 1, wherein the armrest is convertible between a compact position received by the receptacle to produce the step stool and an unfolded position engageable with the bathtub to produce the kneeler.

17. A bathroom furniture kit including components capable of being assembled in one way to produce a step stool and in another way to produce a kneeler, the kit comprising a base unit defining a receptacle, a pair of releasable latch mechanisms, a lid having a step side and a kneel side and releasably securable by the releasable latch mechanisms to the base unit in two alternative positions, each alternative position having a different lid surface abutting the base unit, an armrest, and a connecting member, wherein the armrest and connecting member are received by the receptacle and the lid is releasably secured to the base unit by the releasable latch mechanisms in a first alternative position so that the step side faces upward from the base unit to produce the step stool, and wherein the armrest is outside the receptacle, is connected to the base unit by the connecting member, and is engageable with a bathtub, and the lid is releasably secured to the base unit by the releasable latch mechanisms in a second alternative position so that the kneel side faces upward to produce the kneeler.

18. A bathroom furniture unit comprising a base unit defining a receptacle, a lid releasably securable to the base unit to substantially enclose the receptacle, an armrest having a padded surface and configured alternatively to be received by the receptacle or to engage a ledge of a bathtub, and a connecting member secured to the armrest and configured alternatively to be received by the receptacle and to releasably connect the armrest with one of the base unit and the lid.

19. The bathroom furniture unit of claim 18, wherein the lid has two opposite sides and is configured to be releasably secured to the base unit in two alternative positions such that one side faces upward from the base unit when the lid is in a first alternative position and the other side faces upward from the base unit when the lid is in a second alternative position.

20. The bathroom furniture unit of claim 19, wherein the lid and the base unit together have a first height when the lid is releasably secured to the base unit in the first alternative position and have a second height when the lid is releasably secured to the base unit in the second alternative position, the first height being greater than the second height.

21. The bathroom furniture unit of claim 19, wherein a first of the opposite sides is configured to act as a step when the lid is in the first alternative position and a second of the opposite sides is configured to act as a kneeler when the lid is in the second alternative position.

22. The bathroom furniture unit of claim 21, wherein the second of the opposite sides includes padding.

23. The bathroom furniture unit of claim 18, further comprising at least one releasable latch mechanism for releasably securing the lid to the base unit.

24. The bathroom furniture unit of claim 23, wherein the releasable latch mechanism secures the lid to the base unit in two alternative positions.

25. The bathroom furniture unit of claim 24, wherein the lid has two opposite sides, the releasable latch mechanism is located closer to one side than the other so that the lid and the base unit together have a first height when the lid is releasably secured to the base unit in a first alternative position and have a second height when the lid is releasably secured to the base unit in a second alternative position, and the first height is greater than the second height.

26. The bathroom furniture unit of claim 24, wherein the lid has two opposite sides, one of the opposite sides is configured to act as a step when the lid is in a first alternative position, and the other of the opposite sides is configured to act as a kneeler when the lid is in a second alternative position.

27. A bathroom furniture unit comprising a base unit defining a receptacle, a lid releasably securable to the base unit to substantially enclose the receptacle, at least one releasable latch mechanism for releasably securing the lid to the base unit in two alternative positions, an armrest configured alternatively to be received by the receptacle or to engage a ledge of a bathtub a connecting member secured to the armrest and configured alternatively to be received by the receptacle and to releasably connect the armrest with one of the base unit and the lid, and wherein the lid defines a pocket and a pair of holes, the releasable latch mechanism includes a pair of latches, the releasable latch mechanism is received by the pocket such that the engaging members protrude through the holes, and the base unit defines a pair of apertures for receiving the latches to releasably secure the lid to the base unit.

28. The bathroom furniture unit of claim 27, wherein the releasable latch mechanism includes a button for releasably unsecuring the lid from the base unit.

29. A bathroom furniture unit comprising a base unit defining a receptacle, a lid releasably securable to the base unit to substantially enclose the receptacle, an armrest configured alternatively to be received by the receptacle or to engage a ledge of a bathtub, a connecting member secured to the armrest and configured alternatively to be received by the receptacle and to releasably connect the armrest with one of the base unit and the lid, and wherein the armrest is foldable between a compact position to be received by the receptacle and an unfolded position for engaging the ledge of the bathtub.

30. A bathroom furniture unit comprising a base unit defining a receptacle, a lid releasably securable to the base unit to substantially enclose the receptacle, an armrest configured alternatively to be received by the receptacle or to engage a ledge of a bathtub, a connecting member secured to the armrest and configured alternatively to be received by the receptacle and to releasably connect the armrest with one of the base unit and the lid, and further comprising at least one suction cup secured to the connecting member configured to releasably secure to a side of the bathtub.

31. A bathroom furniture unit comprising a base unit defining a receptacle, a lid releasably securable to the base unit to substantially enclose the receptacle, an armrest configured alternatively to be received by the receptacle or to engage a ledge of a bathtub, a connecting member secured to the armrest and configured alternatively to be received by the receptacle and to releasably connect the armrest with one of the base unit and the lid, and wherein the connecting member is pliable.

* * * * *